US005361922A

United States Patent [19]

Moore et al.

[11] Patent Number: 5,361,922

[45] Date of Patent: Nov. 8, 1994

[54] CENTRIFUGE TUBES WITH SNAP PLUGS

[75] Inventors: Patrick O. Moore, Gilroy; David L. Schiessler, Palo Alto, both of Calif.

[73] Assignee: Beckman Instruments, Inc., Fullerton, Calif.

[21] Appl. No.: 42,352

[22] Filed: Apr. 2, 1993

[51] Int. Cl.[5] ..... B65D 39/00

[52] U.S. Cl. ..... 215/364; 215/296; 220/307

[58] Field of Search ..... 215/364, 355, 296; 494/16; 220/307

[56] References Cited

U.S. PATENT DOCUMENTS

| | | | |
|---|---|---|---|
| 3,168,961 | 2/1965 | Yates | 220/307 |
| 3,262,599 | 7/1966 | Muller | 220/307 |
| 3,842,790 | 10/1974 | Clark | 215/296 X |
| 3,874,541 | 4/1975 | Lagneaux et al. | 215/264 X |
| 4,290,550 | 9/1981 | Chulay et al. | 233/26 |
| 4,304,356 | 12/1981 | Chulay et al. | 233/26 |
| 5,127,895 | 7/1992 | Pawlovich | 494/16 |

*Primary Examiner*—Steven M. Pollard
*Attorney, Agent, or Firm*—William H. May; Gary T. Hampson

[57] ABSTRACT

The present invention directed to a plug for sealing a centrifuge tube. The plug of the present invention is shaped and sized to provide an interference fit between the plug and the tube stem of the centrifuge tube. In the described embodiment, the plug is configured with a tapered body narrowing to a flared end. To facilitate the insertion and removal of the plug with moderate force, without compromising the restraining capability of the interference fit, the area of interference contact between the flared end and the filler stem is strategically reduced. An o-ring is provided in a annular groove around the tapered body. The flared end creates an interference fit with a tapered filler stem, whereby the plug is secured in the filler stem with a snapping action when the flared end of the plug extends into the tube beyond the tapered filler stem. In this snap-in position, the plug is secured in the filler stem, providing an initial seal; such seal increases upon centrifugation by a self-sealing mechanism, either attributed to the internal hydrostatic pressure in the tube and/or the force of a support spacer on the plug. After centrifugation, the snap coupling between the filler stem and the plug securely retains the plug against any residual internal pressure built up within the tube created by deformation of the centrifuge tube either from centrifugation or through handling of the tube by the user.

4 Claims, 3 Drawing Sheets

CENTRIFUGE TUBES WITH SNAP PLUGS

BACKGROUND OF THE INVENTION

1. Field of the Invention

The present invention relates to centrifuge tubes and, more particularly, to the sealing or closing of centrifuge tubes.

2. Description of Related Art

Typical centrifuge tubes have a generally cylindrical body with one end having an filler opening or tube stem to receive the fluid sample to be subject to centrifugation. After the introduction of the fluid sample into the tube, it is necessary to provide a very tight closure or capping means over the open-end of the tube in order to prevent leakage of the contents during centrifugation.

A continual problem with the placement of capping means on the open-ended centrifuge tubes is ensuring that a proper seal is being achieved between the plug and the tube to prevent any possible or potential leakage which could occur under hydrostatic pressure build up within the tube. Hydrostatic pressure within the tube becomes extremely strong when the centrifuge is rotated at speeds of 20,000 rpm or greater.

The significance of eliminating or preventing any potential leakage in a high speed centrifuge cannot be under estimated. The fluid sample may contain some type of pathogen, mutagen, bacteria or other hazardous material. Leakage during the centrifugation run can create a hazardous condition for the operator. The sample may be a small supply of material which cannot be replaced, which the user does not wish to lose through leakage during the centrifugation run. Further, leakage will cause rotor imbalance and result in rotor mishap.

In many instances, the resulting leakage is caused by an improper seal being achieved between the capping means and the centrifuge tube because of either a poor configuration or design of the capping means, or as a result of the improper placement of the capping means on the centrifuge tube. Not only is it important that the capping means be designed to achieve a secure seal between the test tube and the capping means, but also it is important that the capping means have such a design that it is easy to remove after the centrifuge run without having to disturb the contents of the fluid sample after the centrifugation. Otherwise, the separated sample constituents may be remixed and invalidate the centrifugation run.

U.S. Pat. No. 5,127,895 discloses a self-sealing centrifuge tube which makes use of the hydrostatic pressure of the sample solution contained in the tube to engage a tight seal during centrifugation. This patent has been assigned to the assignee of the present invention, and is incorporated by reference herein. The tube stem of the centrifuge tube is capped with a plug and locked into the rotor cavity with a nut and spacer prior to centrifugation. Upon centrifugation, hydrostatic pressure which occurs as a result of a centrifugal force on the solution causes the tube stem to press on the plug against the support provided by the spacer fixed in place within the cavity or the centrifugal weight of the plug. As a result, a seal is formed between the plug and the tube stem. As centrifugal forces increase with an increase in rotor speed, the hydrostatic pressure increases thereby forcing a tighter seal of the plug against the tube stem. The sealing force is therefore commensurated with the magnitude of hydrostatic pressure which is dependent on the centrifugal force experienced by the sample solution contained in the tube. After centrifugation, a weak seal remains between the plug and the filler stem, making it easy for the user to unplug the centrifuge tube without requiring any special tools. The afore-described tube and closure has been commercialized by Beckman Instruments, Inc., California, U.S.A. under the trademark OptiSeal TM.

While the patented self-sealing centrifuge tube and closure provides an excellent seal during centrifugation, it has been found that residual pressure built up within the centrifuge tube due to deformation of the centrifuge tube caused by centrifugation might eject the plug during handling of the centrifuge tube after centrifugation.

SUMMARY OF THE INVENTION

The present invention is an improvement over the prior art self-sealing centrifuge tube and plug. The plug of the present invention is shaped and sized to provide an interference fit between the plug and the tube stem of the centrifuge tube. The interference fit is designed to secure the plug in the tube stem before and after centrifugation, despite residue pressure built up within the tube. The interference fit is also designed to still allow the plug to be easily inserted and removed while maintaining a high degree of holding strength to secure the plug in the filler stem.

In the described embodiment, the plug is configured with a tapered body narrowing to a flared end. An o-ring is provided in a annular groove around the tapered body. The flared end creates an interference fit with a tapered filler stem, whereby the plug is secured in the filler stem with a snapping action when the flared end of the plug extends into the tube beyond the tapered filler stem. In this snap-in position, the plug is secured in the filler stem, providing an initial seal; such seal increases upon centrifugation by a self-sealing mechanism, either attributed to the internal hydrostatic pressure in the tube and/or the force of a support spacer on the plug. After centrifugation, the snap coupling between the filler stem and the plug securely retains the plug against any residual internal pressure built up within the tube created by deformation of the centrifuge tube either from centrifugation or through handling of the tube by the user. To facilitate the insertion and removal of the plug with moderate force, without compromising the restraining capability of the interference fit, the area of interference contact between the flared end and the filler stem is strategically reduced.

DESCRIPTION OF ILLUSTRATED EMBODIMENTS

The following description is of the best presently contemplated mode of carrying out the invention. This description is made for the purpose of illustrating the general principles of the invention and should not be taken in a limiting sense. The scope of the invention is best determined by reference to the appended claims.

The present invention will be described with reference to centrifuge tubes that have a generally cylindrical body portion with top and bottom portions which are integrally formed with the cylindrical body portion (see FIG. 1). The neck or filler stem of the tube is integrally formed around an opening in the top proportion. It will be appreciated that the present invention can be practiced with centrifuge tubes of other body geometries.

As will be appreciated, the capping assembly of the present invention can be applied to wide stem centrifuge tubes. Therefore, the larger opening allows for the use of large diameter syringes or pipettes to load the sample into the tube. This reduces the shear on large biological molecules being loaded into the tube, thereby preserving the integrity of the sample prior to centrifugation. Similarly, when the separated sample is subsequently extracted from the tube after centrifugation, large diameter siphoning tools can be used.

Figure 1:
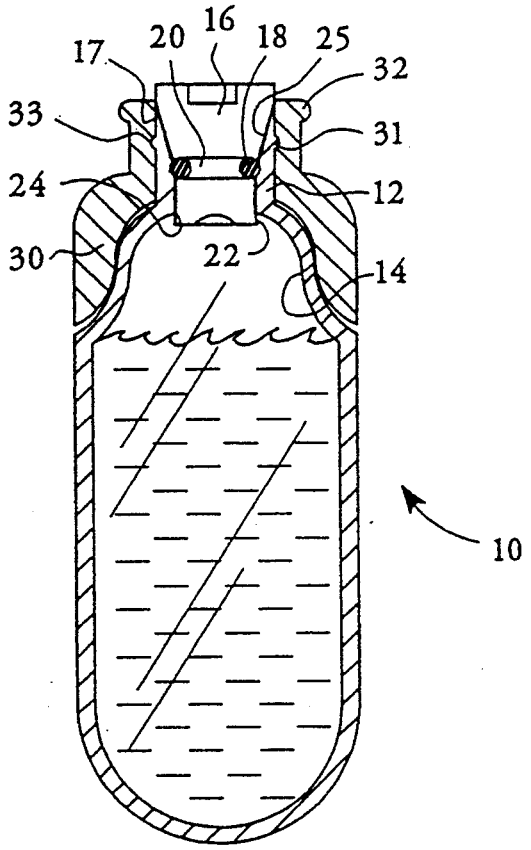
FIG. 1 is a sectional view of a centrifuge tube and a capping assembly in accordance with one embodiment of the present invention.

FIG. 1 shows a capping assembly in accordance with one embodiment of the present invention. The exterior of the tube stem 12 of the centrifuge tube 10 is generally cylindrical. The interior of the stem 12 defines a conically tapered opening which widens outward from the tube at a 12° taper. The stem 12 is integrally formed with the top portion 14 of the tube 10. The plug 16 comprises a conically tapered portion 17 having an o-ring 18 retained in an annular groove 20. The taper of the plug 16 is approximately the same as that of the filler stem opening. The o-ring 18 protrudes above the tapered surface 17 of the plug 16 prior to use. When the plug 16 is inserted into the opening of the tube stem 12, the o-ring 18 comes into sealing contact with the tapered interior surface 25 of the tube stem 12. The tube 10 can be made from a thermoplastic that is preferably translucent or transparent. Polyproplyene or suitable polyolefin are acceptable materials and the tube can be formed by blow molding methods. The plug 16 can also be made from the same material but preferably from polyphenylene oxide, Noryl TM or like material which is slightly harder than polyproplyene but with comparable specific gravity.

Figure 2:
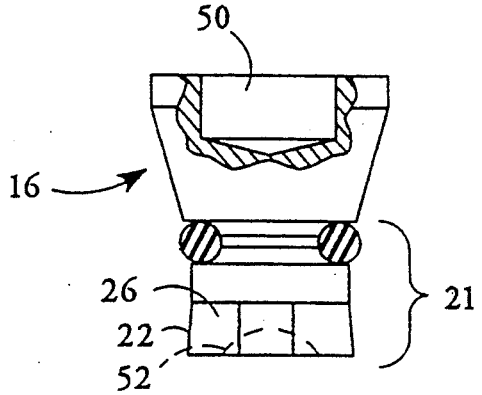
FIG. 2 is a prospective view showing the details of the plug of the present invention.
Figure 3:
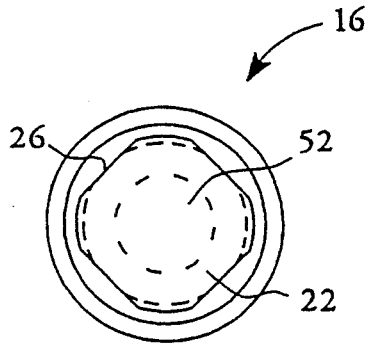
FIG. 3 is a bottom view of the plug in FIG. 2.

According to the present invention, the narrow point 21 of the plug 16 has a flared portion 22 which is flared to be larger in diameter than the constricted diameter 24 of the filler stem 12. In other words, the diameter of the flared end 22 is larger than the constricted diameter 24 of the filler stem 12. Referring to FIGS. 2 and 3, the structure of the plug is more clearly shown. Flats 26 are provided around the circumference of the flared end 22 of the plug 16. The function of these flats 26 will become apparent in the discussion below. A blind hole 50 is used to core out the structure so as to minimize molded-in sink effects. Recess 52 in the flared end of the plug allows for recessing the gate remnant created when molding the plug.

Figure 4A:
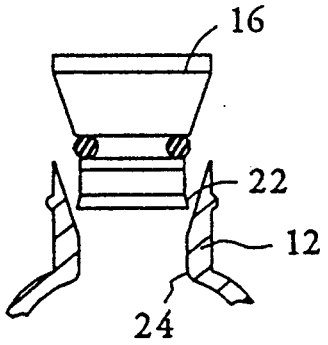
FIG. 4A–D illustrates the sequence of interaction as the plug is inserted into the tube stem.
Figure 4B:
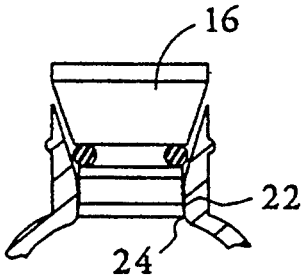
Figure 4C:
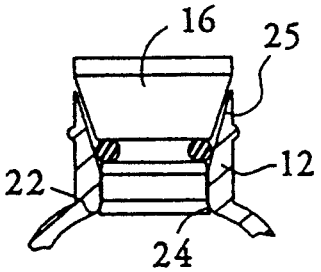
Figure 4D:
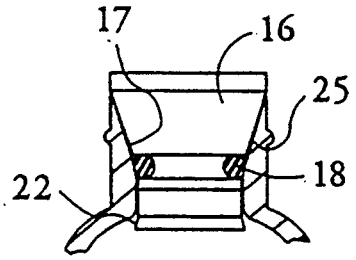

The tube 10 of FIG. 1 is capped by inserting the flared end 22 of the plug 16 into the tube stem opening (FIG. 4A). As the plug 16 moves downward into the tube stem 12, the flared end 22 meets the smaller constricted diameter 24 of the tube stem 12 and encounters an interference type of fit (FIG. 4B). The portion of the constricted diameter 24 being made of a elastic deformable material, begins to elastically stretch and conform to the flared end 22. At this point, the force required to push or insert the plug 16 into the tube stem 12 increases. This increase in force can be quite significant and could prevent the insertion of the plug 16 if it were not for the flats 26 which reduce the line to line interference engagement with the smaller constricted diameter of the tube stem 12. The total circumferential perimeter of the flared end 22 is less than a full circular circumferential perimeter, due to the addition of the flats 26. This reduction of line to line engagement dictates, lessens or limits, the maximum amount of force required to insert the plug 16. Once the flared end 22 moves past the constricted diameter 24 of the tube stem 12, (FIG. 4C) the tapered conical surface of the flared end 22 pulls the plug into the seated position (FIG. 4D), with a snap action. In the seated position (FIG. 4D) the tapered conical surface 17 of the plug 16 engages the tapered conical internal surface 25 of the tube stem 12. During the inward movement of the plug 16 into the internal tapered conical section of the tube stem 12, the circular cross-section o-ring 18 begins to compress against the tapered conical surface 25 of the tube stem 12 (FIG. 4C). When the plug 16 is fully engaged (FIG. D) the o-ring 18 is compressed sufficiently to provide a secure seal which will not allow the passage of fluid or the dislocation of the plug 16 from the tube stem 12 when the tube is being handled.

Figure 5:
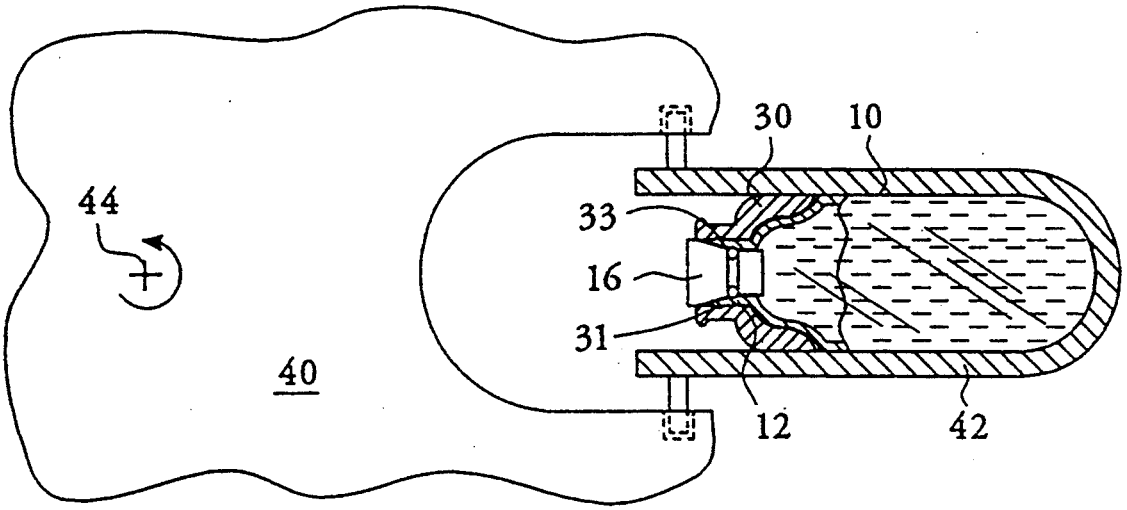
FIG. 5 is a schematic top view of a swinging bucket centrifuge rotor supporting the tube and spacer assembly of the present invention.

The seal is further secured during centrifugation by the additional self-loading provided by a "floating" spacer (in fixed-angle rotor), or the centrifugally induced internal hydrostatic pressure against the top of the tube (in vertical or near vertical tube rotor), depending on the type of rotor in which the tube is used. The spacer is slipped onto to the tube stem 12 after it has been plugged. Referring to FIG. 1, the spacer 30 is specifically designed to have an interior surface that is shaped to generally conform to the tube stem 12 and upper portion 14 of the centrifuge tube. As the spacer 30 will be inserted into the rotor cavity (see FIG. 5), the top of the spacer 30 is shaped with a flange 32 to allow easy removal from the rotor cavity. The spacer 30 can be made from plastic, e.g. Noryl, or light metal such as aluminum. The spacer may be provided with an interlocking feature with respect to the filler stem (an annular ridge 31 on the tube stem 12 and an annular groove 33 in the spacer 30). The interlocking spacer further maintains the tube stem in a constricted configuration to resist withdrawal of the flared end through the constricted diameter under internal hydrostatic pressure. Detail of the interlocking spacer is described in greater detail in copending patent application Ser. No. 08/042,310 (Attorney Docket No. 8D-1157), commonly assigned to the assignee of the present application. The installation of the centrifuge tube 10 and its capping assembly in a swinging bucket centrifuge rotor is schematically shown in FIG. 5.

In the swinging bucket centrifuge rotor 40, the centrifuge tube 10 is held in the cavity of a pivotally supported bucket 42 which swings outward to a horizontal position upon centrifugation about axis 44. (See FIG. 5). The use of floating spacers in the past has been described in U.S. Pat. No. 4,304,356. The floating spacer provides support against deformation of the centrifuge tube by hydrostatic and centrifugal forces. The spacer 30 is floating in the sense that it is free to move along the cavity except for the interaction with the tube and the frictional contact between the spacer and the cavity. The spacer 30 should be of a density slightly less than the average density of the sample solution to avoid centrifuging the spacer towards the bottom of the bucket in the event that the centrifuge tube ruptures. Alternatively, a counter bore (not shown) may be provided in the opening of the bucket to restrain excessive movement of the spacer towards the bottom of the bucket.

Post centrifugation, the spacer 30 with the interlocking feature 31 and 32, is removed from the bucket 42 along with tube 10. The spacer 30 can be easily removed from the tube stem 12 without requiring a tool with a twisting and pulling motion. The plug 16 can be removed from the tube stem 12 with an appropriate extraction tool (see FIG. 9).

Figure 6:
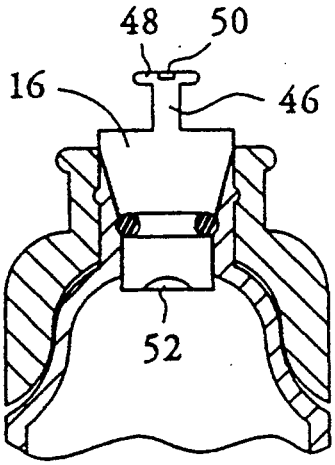
FIG. 6 is a sectional view of another embodiment of the plug in accordance with another embodiment out of the present invention.

It has been found that in order to allow extraction of the plug in the event the flat top of the plug 16 drops below the top of the opening of the tube stem 12 due to high centrifugal force, it is desirable to provide an extension on the top of the plug. Referring to FIG. 6 the plug 16 has an extended post 46 rising above the shoulder. At the top of the post 46 is a circular flange 48. A blind hole 50 is used to core out the structure so as to minimize molded-in sink effects. Recess 52 in the flared end of the plug allows for recessing the gate remnant created when molding the plug. Post centrifugation, the post with the molded on flange allows for the convenient grasping of the plug for removal of the plug from the tube stem.

Figure 7:
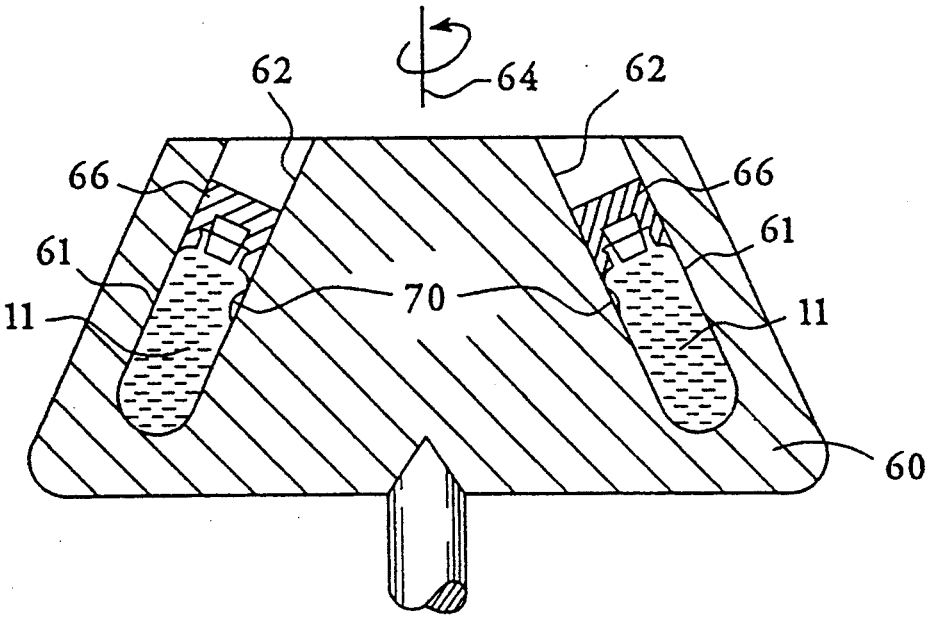
FIG. 7 is a sectional view of a fixed angle rotor carrying a centrifuge tube and closure assembly in accordance with the present invention.

Referring to FIG. 7 the use of the tube and closure system in fixed angle rotors will now be discussed. The rotor 60 has several cavities 62 oriented at a fixed predetermined angle to the spin axis 64 and arranged in a circle at equal distance from the spin axis. The cavities 62 are shaped to receive the centrifuge tube 61 and its accompanying capping assembly. The centrifuge tube is filled with a sample solution 11 prior to inserting into the rotor cavity.

Figure 8:
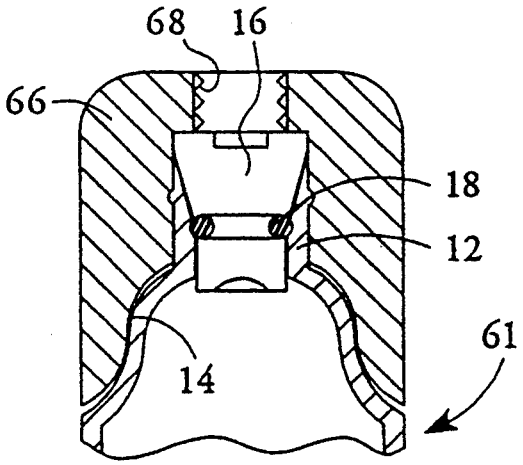
FIG. 8 is a sectional view of a spacer for use in a fixed angle rotor.

Referring to FIG. 8, the spacer 66 suitable for use in fixed angle rotors is more clearly shown. The spacer 66 covers the plug 16. A threaded hole 68 is provided just large enough for a threaded tool (not shown) to be used for removal of the spacer 66 from the rotor cavity 62. The preferred profile of the top portion 14 of the tube; and thus the tube conforming profile of the spacer 66, is bell-shaped for the specific application in fixed angle rotors.

The tube 61 is plugged and inserted into the rotor cavity 62 followed by the spacer 66. A ridge-and-groove interlocking structure as described before may also be implemented on the tube 61 and spacer 66 for use in fixed angle rotors. The spacer 66 is floating in the sense that it is free to move along the cavity 62 except for the interaction with the tube 61 and the frictional contact between the spacer 66 and the cavity 62. In the present invention, the self-loading of the floating spacer during centrifugation transfers force on the plug 16 through contact with the flat top of the plug. Upon centrifugation, the sample solution 11 within the tube is subject to centrifugal force radially outward with respect to the spin axis. The solution takes a vertical orientation and a vertical meniscus 70 is formed. The amount of air space above the meniscus will depend on the level to which the tube is filled with sample solution. Although a large air space above the meniscus 70 is shown in exaggeration for clarity, it is preferred to fill the tube completely to keep the air space above the meniscus as small as possible in order to avoid the walls of the tube from otherwise collapsing under the high centrifugal force. The vertical column of sample solution 11 comes into contact with a portion of the upper portion 14 of the tube 61 and the plug 16. Depending on the level of the sample solution to which the tube was filled, a substantial portion of the upper portion of the tube around the plug 16 is subject to hydrostatic pressure of the sample solution upon centrifugation. Upward movement of the plug 16 under hydrostatic pressure is constrained by the centrifugal loading of the floating spacer 66. In fact, the self-loading of the floating spacer 66 presses on the plug 16 against the hydrostatic pressure on the top portion 14 of the tube. The seal against the o-ring 18 becomes tighter as a result. Thus, as the rotor speed increases, the centrifugal force and hence, the hydrostatic pressure increases thereby increasing the sealing force at the interface of the o-ring 18 and the tube stem 12. The increased sealing force counteracts for the increase in hydrostatic pressure thereby maintaining a tight leak-proof seal. In other words, the seal becomes "better" as the pressure condition becomes more severe.

After centrifugation is completed, the spacer 66 is removed from the rotor cavity 62 by pulling on the threaded hole 68 on the spacer 66. The centrifuge tube 61 is pulled out of the cavity and the plug 16 removed using the tool described with reference to FIG. 9 herein below. If a spacer 30 with interlocking features 31 and 32 is used, the spacer will be removed along with the tube from the rotor cavity. It is noted that the plug 16 is retained in the tube stem 12 even in the presence of residual pressure built up within the tube caused by permanent tube deformation from centrifugation. The difference or degree of interference between the flared end 22 and the constricted diameter 24 is directly proportional to the retaining or restraining force of the plug. There are balances struck between the amount of force required to insert the plug, the size of restraining capability of the plug, and the amount of force required to remove the plug from the tube stem.

It has been found that an adequate line to line interference engagement between the tube and the plug is about 50 to 60%, with a reduction of circular circumferential perimeter by about 0.5 to 2% at the flared end by providing flats 26. It is believed that the amount of reduction in the circular circumferential perimeter affects the insertion force required for the plug; a larger insertion force is required with less reduction. It is believed that the percentage of interference engagement between the tube and the flared end dictates the extraction force required to remove the plug from the tube; the extraction force increases with larger percentage of engagement.

Centrifuge tubes having top portions 14 of other geometries may be used in accordance with the present invention. For example, conical and hemi-spherical top tubes may be used.

Figure 10:
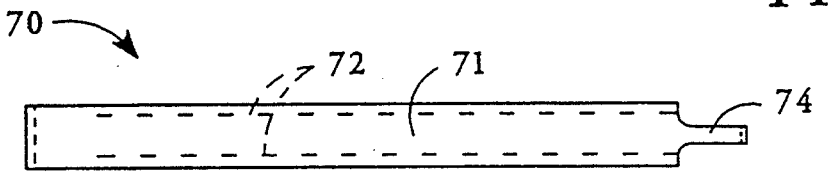
FIGS. 9–11 are different views of a tool designed for extraction of the tube from the rotor cavity and for removing the plugs from the tube stems after centrifugation.
Figure 9:
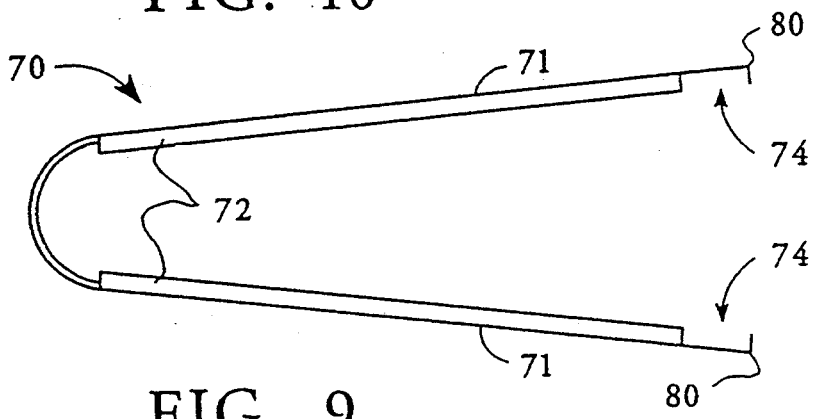
Figure 11:
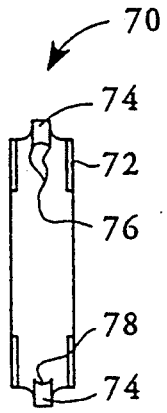

An extraction tool has been designed for use to extract the centrifuge tube disclosed herein from rotor cavities. Referring to FIGS. 9–11, the extraction tool 70 is formed of a hardened spring steel or other similar material into the shape shown in the figures. The tool 70 has ribs 72 which provide strength and stiffness to the side members 71. The ribs 72 run the length of the straight section of the tool 70. At opposing ends of the structure are right angle tabs 74 turning inward toward the center line of the structure. These tabs 74 have at their ends sharp corners 76 resulting from a predetermined radius 78 formed at the ends. The length of the tabs 74 from the bends 80 to the sharp corners 76 is set so as to allow the device to reach into the smallest centrifuge rotor cavity to extract the tubes by their stems. The device is used by applying finger pressure at or along the side members 71. The points 76 bite into the side of the tube stem 12, since the radius 78 is set to be slightly less than the radius of the tube stem. The lodging of the points 76 into the tube stem material provides resistance to slip in the tube axial direction. Prior art laboratory tweezers do not have the gripping ability because they are designed to hold, not bite into the material being handled, and thus they disturb the plug and hence compromise the seal.

While the invention has been described with respect to the preferred embodiments in accordance therewith, it will be apparent to those skilled in the art that various modifications and improvements may be made without departing from the scope and spirit of the invention. Accordingly, it is to be understood that the invention is not to be limited by the specific illustrated embodiments, but only by the scope of the appended claims.

We claim:

1. A plug for insertion into a neck of a centrifuge tube comprising:

a top portion, a bottom portion, and a conically tapered body between the top and bottom portions having a narrow portion with a lower end that flares outwardly and downwardly defining a flared portion with a plurality of circumferentially spaced tangential flats on a conical section having a first diameter greater than a second diameter as defined by said neck of a centrifuge tube, said flared portion resting beneath said neck when said plug is in a final sealing position forming an interference fit with said neck, said narrow portion having an annular groove and an o-ring received therein, the o-ring sealing the space between the neck and the conically tapered body.

2. A plug as recited in claim 1 wherein said top portion has a post extending vertically upward therefrom and terminating in an end, said end having a circular flange.

3. A capping assembly for centrifuge tubes comprising:

a centrifuge tube including a generally cylindrical body terminating in a closed portion with a cylindrical tube stem defining a neck opposite said closed portion, said neck including an upwardly and outwardly conically tapered interior, a plug for insertion into said neck having a top portion, and a body portion, between the top and bottom portions, conically tapered to match a profile of said interior and having a narrow portion with a lower end that flares outwardly and downwardly defining a flared portion with a plurality of circumferentially spaced tangential flats and a conical section having a first diameter greater than a second diameter as defined by said neck of a centrifuge tube, said flared portion resting beneath said neck when said plug is in a final sealing position forming an interference fit with said neck, said narrow portion having an annular groove and an o-ring received therein, the o-ring similarly spaced between the neck and the conically tapered body.

4. A plug as recited in claim 3 wherein said top portion has a post extending vertically upward therefrom and terminating in an end, said end having a circular flange.

* * * * *